United States Patent [19]

Porciello

[11] 4,359,227

[45] Nov. 16, 1982

[54] GAME OF CHANCE

[76] Inventor: Joseph Porciello, 12 Marie Dr., Apt. 9, Seymour, Conn. 06483

[21] Appl. No.: 249,026

[22] Filed: Mar. 30, 1981

[51] Int. Cl.[3] ..... A63F 3/00

[52] U.S. Cl. ..... 273/268

[58] Field of Search ..... 40/154; 273/260, 268, 273/271, 286, 287, 141; 434/172, 205

[56] References Cited

U.S. PATENT DOCUMENTS

| | | | |
|---|---|---|---|
| 1,238,522 | 8/1917 | Kalista | 273/269 |
| 1,364,778 | 1/1921 | Mathews | 434/172 |
| 1,538,307 | 5/1925 | Strehlow | 273/141 R X |
| 1,613,204 | 1/1927 | Smith | 434/172 X |
| 3,652,086 | 3/1972 | Stecker | 273/148 R X |

FOREIGN PATENT DOCUMENTS

| | | | |
|---|---|---|---|
| 304440 | 1/1929 | United Kingdom | 273/268 |
| 991386 | 5/1965 | United Kingdom | 273/274 |

*Primary Examiner*—Harland S. Skogquist

*Attorney, Agent, or Firm*—Arthur T. Fattibene

[57] ABSTRACT

A game of chance which comprises a board for each player wherein each board has removably supported thereon a plurality of game tokens in the form of dominos containing indicia thereon, and a chance indicating device in the form of a pair of dice or a spinner having indicia thereon corresponding to the indicia on said dominos whereby the object of the game is for each player in turn to remove the game tokens from his board by chance by matching the indicia of the indicating device with the indicia of the dominos. The indicating device in addition includes non-matching indicia to indicate a passing of play to the next player.

1 Claim, 4 Drawing Figures

GAME OF CHANCE

PRIOR ART

Various games have been conceived utilizing the use of dice and spinners as a chance indicating device. Also, various known games utilize different kinds of tokens or game pieces which generally moved about a game board during the play of the game. Games have been developed which utilized these known components to provide games which are generally based on a combination of skill and chance. Some such known dice games are evidenced by U.S. Pat. Nos. 3,652,086; 3,747,934, and 3,744,800; 3,989,243, and 4,043,560. Game pieces such as card like tokens or dominos are also known such as evidenced by U.S. Pat. Nos. 1,165,984 and 630,485. Many such games have relatively complex mechanical structures, frequently having or requiring moving parts all of which greatly burdens the cost of such games. Frequently, such games require relatively complicated rules or require some skill or judgment to effect the play of the game, thus limiting the games to persons of specific age groups. Other such games are limited in play value and thereby fail to hold the interest of the players for any extended period of time.

OBJECTS

An object of this invention is to provide a game of chance which is relatively simple in construction, relatively inexpensive to produce and is interesting and amusing to play.

Another object to provide a game of chance which can be readily played by one or more persons; and which requires no special skills or exercise of judgment.

Another object is to provide a game of chance having a theme which can be readily comprehended by persons ranging from the very young to the very old.

Another is to provide a relatively simple game capable of maintaining one's interest over a considerable period of time.

BRIEF SUMMARY OF THE INVENTION

The foregoing objects and other features and advantages are readily attained by each player being provided with a game board having a plurality of game pieces positioning stations thereon and having a game token or piece removably supported at each station.

The game pieces are each provided with an indicia which may consist of a number or symbol representing a finite symbol. A chance indicating device in the form of a pair of dice or spinner is provided and which dice or spinner has indicia or markings thereon to correspond with the respective indicia or symbols of the game piece. In addition, the indicating device includes one or more indicia which does not correspond to any indicia of the game pieces. The object of the game is for each player in turn to effectively remove the game pieces or tokens from his board or turn over the dominoes by matching the indicia selected by chance by the operation of the indicating device to the indicia of the game pieces on the player's board. The player who is the first to remove all of the tokens from his board is the winner.

FEATURES

A feature of this invention resides in the provision of a plurality of game boards, each of which contains a positioning station for removably receiving a game token.

Another feature resides in the provision wherein the game tokens comprise a series of dominos.

Another feature of this invention resides in the provision of dominos having the various indicia combination other than that totaling a specific sum, e.g. seven.

Another feature of this invention resides in the provision wherein the chance indicating means may comprise a pair of dice, spinner or like chance indicator.

Other features and advantages will become more readily apparent when considered in view of the drawings and specifications in which.

DETAIL DESCRIPTION

Figure 1:
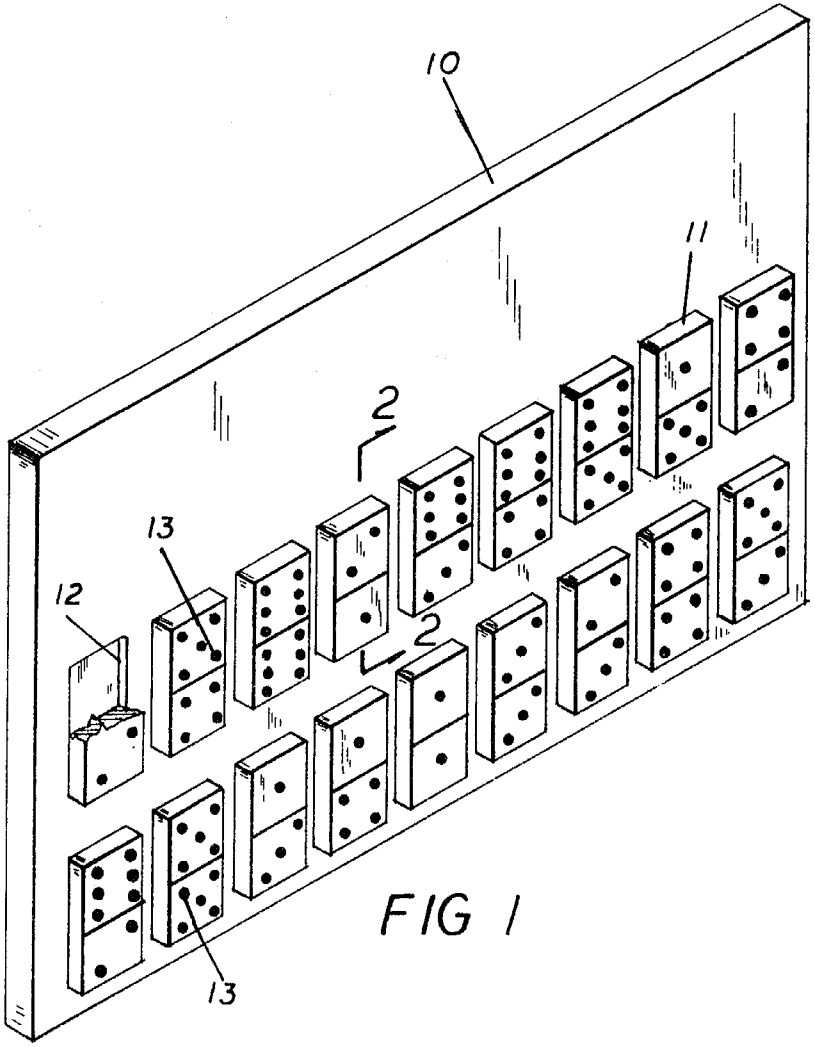
FIG. 1 is a perspective view of a game board of this invention, showing the game pieces in place thereon.
Figure 2:
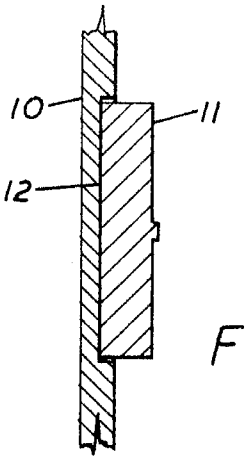
FIG. 2 is a detail sectional view taken along line 2—2 on FIG. 1.
Figure 4:
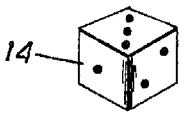
FIG. 4 illustrates a type die of a pair of dice which may function as the chance indicator.

The present invention is directed to a game of chance which may be played by one, but preferrably by two or more players. Each player is provided with a board 10 and a plurality of game pieces or tokens 11. As shown, each board 10 is generally rectangular in shape having formed thereon a plurality of token positioning means. In the illustrated embodiment the positioning means are shown as comprising a recess or indentation 12 formed on the board 10 in some desired array. As shown, two rows of spaced apart recesses 12 are formed on the surface of the board 10.

The game pieces or tokens 11 include a series of dominos. As shown, each of the dominos 11 is provided with the usual indicia means 13 in the form of dots. The combination of the sum of dots formed on each of the dominos range between 2 to 12, with all combinations of 7 being omitted.

Where a pair of dice 14 are used as the change indicating means, the indicia on the dice will correspond with the indicia of the dominos, except that the dice will include those combination of die markings which totals 7. Except for the 7 combination, the marking of the dice will correspond and match the combination of indicia on the face portions of the game pieces or dominos 11.

To effect the play of the game, each player is provided with a board 10 and a corresponding set of game pieces or dominos 11. Each player arranges his set of dominos 11 on his board, face up so that the markings or indicia on each dominos is readily visible and can be observed. The game is played by each player in turn throwing the pair of dice. Upon the throw of the dice, the markings or indicia on the dice will either match the markings on one or more of the player's dominos or with "seven," a nonmatch. Upon a match being made, the dominos corresponding to the match are removed from the player's board, or turned over and another throw is made by the player. Each time a match is made the matching dominos are removed or turned over. The player continues the successive throws of the dice until he no longer can make a match or "sevens." In such event the dice is passed to the next player and the procedure is repeated until the succeeding player fails to make a match or "sevens." Each player in turn repeats this procedure until one player has successfully emptied his board of game pieces or dominos 11. The player who first empties his board is declared the winner. If desired the play of the game may continue until all players have cleared their board, or a new game may be started.

Figure 3:
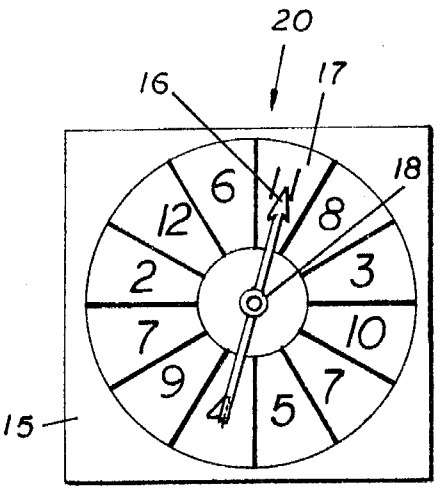
FIG. 3 is a chance indicating means in the form of a spinner.

In lieu of dice 14, as the chance indicator, a spinner 20 may be used. As shown on FIG. 3 the spinner comprises a base member 15 having rotatably journalled thereon, a spinner or pointer 16. The base member 15 is formed with a plurality of segments 17 extending radially from the pivot center 18 of the pointer 16. As shown, the segments 17 correspond in number to at least one more than the number of the sums of the respective game pieces 11. Corresponding segments 17 of the spinner 15 are provided with a marking or indicia which match the markings or sum on the respective dominos 11. In addition, the spinner 15 is provided with one or more segments having a marking which does not correspond to any marking on the dominos. The non-matching markings are provided on the chance means whereby the player will lose his turn if the spinner falls on such unmatched marking. For illustrative purposes, the non-matching segment may be marked or identified by the number of indicia 7. Thus, the play of the game is the same regardless of whether the chance indicating means comprise the pair of dice 14 or spinner 20 as hereinbefore described.

It will be understood that the player of the game can be varied by modification of the rules. For example, the rules of the game may include the rule that upon rolling a double on the dice, i.e. double "one" "two", etc, the player would be entitled to another turn whether he has made a match or not. If the spinner 20 is used as the indicating means, certain markings thereon may be considered "wild" permitting a player to take another turn whether a match is made or not.

While the invention has been described with respect to a particular embodiment thereof, variations and modifications may be made without departing from the spirit or scope of the invention.

What is claimed is:

1. A game of chance comprising a flat board, a plurality of positioning means in the form of recesses located on said board, a plurality of tokens formed as dominos which correspond in number to the number of recesses on said board, each of said dominos being arranged in one of said positioning recesses, each of said dominos having indicia means formed on one surface thereof, said indicia means ranging from 2 to 12 less one indicia within said range, a chance indicating means having indicia formed thereon corresponding to the range of indicia means on said dominos plus said one less indicia, said dominos being detachably disposed in said positioning recess whereby said dominos can be readily removed from or turned over by the matching of the indicia means of said dominos by the corresponding indicia produced by said chance means during the play of the game, and said chance means being passed to the next player when said indicia on said chance means fails to match a corresponding indicia means on said dominos or corresponding to said one less indicia means on said chance means.

* * * * *